United States Patent [19]

Beisswanger

[11] Patent Number: 4,508,283

[45] Date of Patent: Apr. 2, 1985

[54] WINDING MACHINE FOR WINDING A WEB SLIT LENGTHWISE

[75] Inventor: Rudolf Beisswanger, Steinheim, Fed. Rep. of Germany

[73] Assignee: J. M. Voith GmbH, Heidenheim, Fed. Rep. of Germany

[21] Appl. No.: 551,954

[22] Filed: Nov. 15, 1983

[30] Foreign Application Priority Data

Nov. 27, 1982 [DE] Fed. Rep. of Germany ..... 3243994

[51] Int. Cl.[3] ..... B65H 17/12; B65H 19/06

[52] U.S. Cl. ..... 242/56.4; 242/66

[58] Field of Search ..... 242/56.4, 56.6, 56.9, 242/66

[56] References Cited

U.S. PATENT DOCUMENTS 817,026 4/1906 White ..... 242/66

FOREIGN PATENT DOCUMENTS 697347 9/1940 Fed. Rep. of Germany ..... 242/66

1217482 12/1970 United Kingdom ..... 242/66

*Primary Examiner*—Stuart S. Levy

*Assistant Examiner*—Lloyd D. Doigan

*Attorney, Agent, or Firm*—Albert L. Jeffers; Stephen T. Belsheim

[57] ABSTRACT

In a winding machine for simultaneously winding strips, which are offset relative to each other and have been slit lengthwise from a web, onto at least two winding rolls, three supporting rollers are provided mounted with their longitudinal axes generally parallel in the machine frame, wherein each pair of adjacent supporting rollers are arranged next to each other such that the winding bed, into which a web strip is supplied from below, extends above the common plane through the center axes of the adjacent supporting rollers. To relieve the weight of the respective rolls, holding assemblies engage the ends of the respective core tubes. Above the central supporting roller, there is an apparatus for ejecting the finished roll over the outermost supporting roller, and thereafter a removal device removes the finished roll. Inserting devices are also provided for placing new core tubes into their respective winding beds. The machine thus described enables rolls of web strips to be automatically changed.

15 Claims, 4 Drawing Figures

WINDING MACHINE FOR WINDING A WEB SLIT LENGTHWISE

BACKGROUND OF THE INVENTION

This invention relates to a winding machine, and more particularly to a winding machine for simultaneously winding strips, which are offset relative to each other and have been slit lengthwise from a web, onto at least two winding rolls.

A winding machine of this type is disclosed in DE-OS No. 20 15 722, wherein the three supporting rollers are arranged one above the other. One winding bed extends on one side of this roller arrangement and a second winding bed extends on the other side. In this disclosed winding machine, the total weight of the rolls is virtually entirely supported by the holding devices which engage the ends of the winding core tubes. Consequently, this winding machine is generally unsuitable for producing heavy, wide rolls.

Another type of winding machine for winding an undivided web onto a roll is disclosed in U.S. Pat. No. 3,869,095. This machine has three supporting rollers mounted in a machine frame with their longitudinal axes generally parallel to each other, each two adjacent rollers forming therebetween a respective winding bed. In this machine, the winding beds are used alternately to allow continuous winding to be achieved. This machine is generally not suitable, not desirable, for winding webs, which are slit lengthwise, in a winding bed because there is the possibility that, since the strips are not precisely guided, that the ends of the winding rolls will be crushed against each other and ruined.

The winding machine of the present invention is based on the problem of providing a winding machine in which high quality wound rolls of any length can be efficiently produced automatically.

The winding machine of the present invention includes the advantage wherein the weight of each wound roll is supported by two supporting rollers, namely, the central supporting roller and one of the two outermost supporting rollers. In this manner, each roller is required to support only a fraction of the weight of the roll. Further, the linear pressure on the supporting rollers is kept to a minimum, so that the web on the winding roll is not subjected to any overstressing condition. Moreover, the two supporting rollers provide reliable and stable support for the roll over its entire axial length, thereby preventing the sagging of long winding rolls.

By feeding the web strips into the winding beds from below the winding beds, and using supporting rollers with multiple motor drives, the roll density can be reliably controlled in an easy manner with different amounts of pressure or torque acting on the rollers.

The compact arrangement of the ejection apparatus above the central supporting roller provides a compact machine requiring a minimum amount of space. Furthermore, the winding machine of the present invention provides a process for quickly and automatically changing rolls because of the simultaneous ejection of finished rolls from their respective winding beds, their removal from the machine in conjunction with the inserting device for inserting new core tubes, a severing device that severs the wound web strips, and a device that attaches the new web strips to the new core tubes with an adhesive material. Manual intervention during a roll changing operation is therefore eliminated.

The winding machine of the present invention provides various embodiments in which the three supporting rollers are arranged. In one embodiment, the axes of all three supporting rollers lie in a common plane, which is obliquely inclined relative to the horizontal and viewed in the axial direction. By inclining the common plane of the three supporting rollers, the different distribution of the weight components of the winding rolls on the supporting rollers can be used to vary the roll density. In this embodiment, the outermost supporting roller that is disposed higher than the other two supporting rollers is mounted such that it can be lowered relative to the other supporting rollers to permit its wound roll to be just as easily ejected from its winding bed, as the other roll is from its lower winding bed.

In another embodiment of the winding machine of the present invention, the central supporting roller is disposed with its longitudinal axis above the common center axis plane of the outermost supporting rollers. In this embodiment, with relatively small diameter supporting rollers, sufficient space is created above the central supporting roller for mounting the ejection apparatus or apparatuses. In this case, all three supporting rollers may have approximately the same diameters, however, improved spatial conditions exist above the central supporting roller when the diameter of the central supporting roller is greater than the diameters of the outermost supporting rollers.

In an expedient fashion, it is possible to influence the roll density as the weight of the roll increases by providing the holding assemblies with clamping heads that act on the core tube of the roll, and which are longitudinally movable along the path of the roll axis with adjustable weight-relieving of the roll. However, to achieve a firm initial winding, each roll is provided with a loading device having an adjustable loading roller effective to apply a force or pressure in the direction of the winding bed.

Optimum conditions for saving space and for the efficient operation of the winding machine of the present invention are obtained when the ejection apparatus comprises a beam pivotal around the central supporting roller for each winding bed, and which has mounted on its upper side the core tube insertion device. New core tubes are thus being moved toward respective winding beds when the ejection beams push the finished rolls over their respective outermost supporting rollers.

The insertion device comprises a sliding carriage which is movable along the axial length of the ejection beam when the ejection beam is at its rest position. The sliding carriage is then loaded with new core tubes when it has been moved out of the winding machine. Thus, loading of the carriage can be accomplished at an easily accessible location without affecting the winding process. The insertion device further comprises clamping shoes for holding the core tubes in the correct position on the sliding carriage, thereby preventing their displacement during movement of the carriage. The insertion device does not release the core tubes until the ejection beam is in its working position, at which time they are supplied on guides to the respective holding assemblies and gripped by the clamping heads. To prevent the guides from adversely affecting the rolling process, the guides are formed as rails mounted on respective holding assemblies such that they are extendable upwardly toward the insertion devices, thereby allowing the new core tubes to roll obliquely downwardly to the clamping heads. After a new core tube has been clamped, the guide rails are withdrawn into the holding assemblies.

BRIEF DESCRIPTION OF THE DRAWINGS

The above-mentioned and other features and objects of this invention, and the manner of attaining them, will become more apparent and the invention will be better understood by reference to the following detailed description of the invention taken in conjunction with accompanying drawings, wherein.

DETAILED DESCRIPTION

Figure 1:
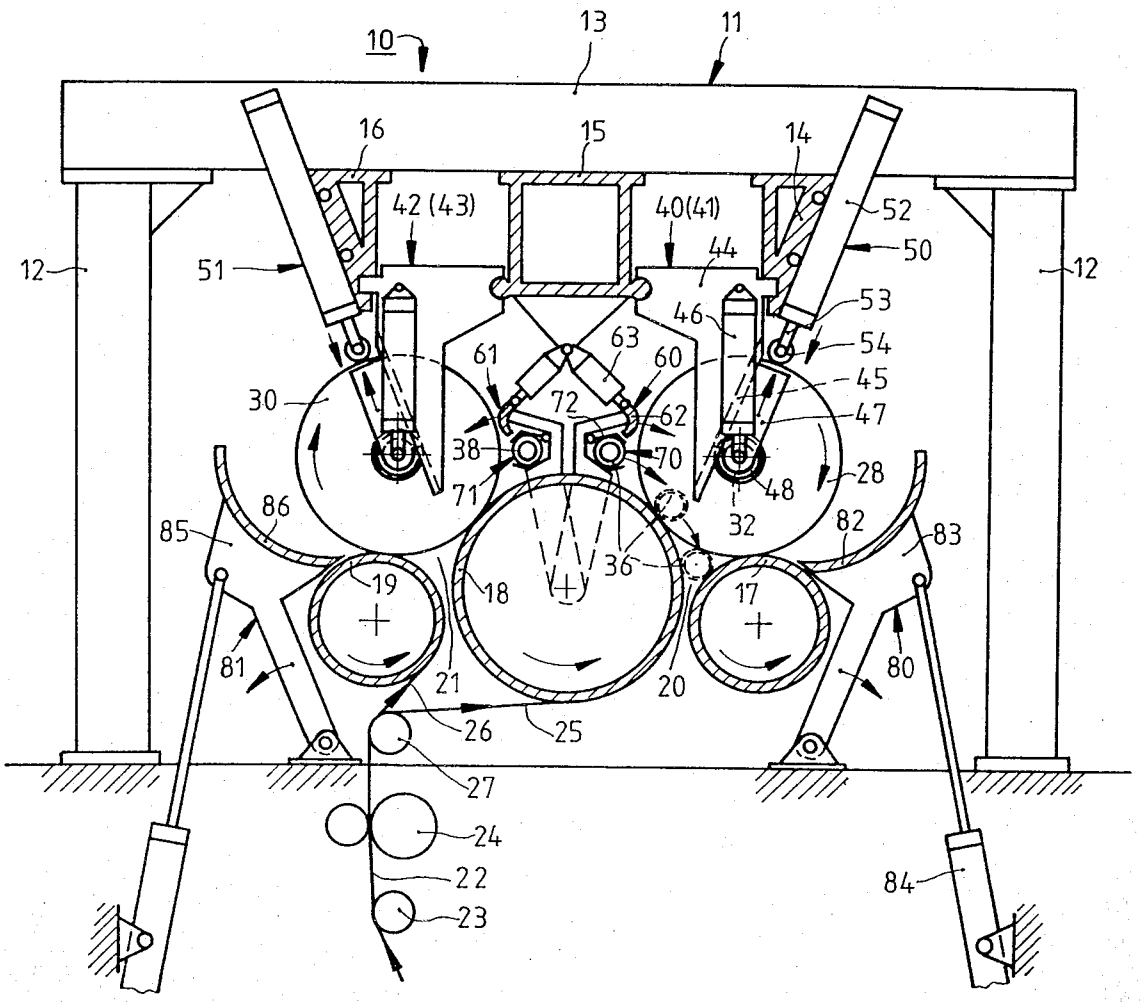
FIG. 1 is a sectional view of one embodiment of the present invention illustrating the central supporting roller having a greater diameter than the two outermost supporting rollers and disposed higher than the outermost supporting rollers, and the ejecting apparatuses and insertion devices disposed above the central supporting roller.

Referring to FIG. 1, winding machine 10 includes machine frame 11 having uprights 12 arranged in the corners thereof and connected by cross-beams 13. Beams 13, which are arranged on either side of machine 10, support three stringers 14, 15, and 16, which extend parallel to each other. Three supporting rollers 17,18, and 19 are mounted in frame 11 with their longitudinal axes generally parallel to each other. The longitudinal axes of rollers 17–19 extend generally parallel to the longitudinal axes of stringers 14–16. Each of the supporting rollers 17–19 is equipped with a drive (not shown) for the rotation thereof. The two outermost supporting rollers 17 and 19 are disposed at approximately the same height and have smaller diameters than roller 18, the longitudinal axis of which is elevated relative to the longitudinal axes of rollers 17 and 19. Each pair of adjacent supporting rollers 17, 18 and 18, 19 form a winding bed which extends above the common center axis plane of these pairs of rollers, i.e., supporting rollers 17 and 18 form winding bed 20 therebetween, and supporting rollers 18 and 19 form winding bed 21 therebetween.

A web 22 of paper is supplied over deflection roller 23 below machine frame 11. Web 22 passes through a lengthwise cutting device 24 in which web 22 is cut into lengthwise strips 25 and 26. After passing over deflection roller 27, web strip 25 runs from below the round part of the circumference of central supporting roller 18 into winding bed 20, where it is wound onto roll 28 supported in winding bed 20. Web strip 26 runs over the outer supporting roller 19 into winding bed 21 and from there onto winding roll 30 supported in winding bed 21.

Winding machine 10 is equipped with various assemblies and devices, which are present at least in pairs, and is constructed substantially mirror-symmetrical to the vertical plane passing through the longitudinal axis of central supporting roller 18. Among the various assemblies and devices present, there are two holding assemblies 40, 41 and 42, 43, respectively, for each of the winding rolls 28, 30, respectively. Loading devices 50 and 51 are provided for each roll 28, 30 respectively, and roll ejecting apparatuses 60 and 61 are provided for rolls 28 and 30, respectively. Core tube insertion devices 70 and 71 are provided for rolls 28, 30, respectively, and removal devices 80 and 81 are likewise provided for rolls 28, 30, respectively. Since winding machine 10 is constructed substantially mirror-symmetrical, a description of only one of each these assemblies, apparatuses, and devices will be made.

Holding assembly 40 comprises holding arm 44 which extends downwardly toward winding bed 20. Holding arm 44 can be displaced between stringers 14 and 15. Arm 44 is provided with guide track 45 for sliding carriage 47, which can be displaced on holding arm 44 by displacement motor 46. On the side nearest winding bed 20 sliding carriage 47 has a clamping head 48 which engages an end section of core tube 32 of roll 28, while the other end of core tube 32 is associated with holding device 41. As described, clamping head 48 of holding assembly 40 follows the path of the axis of roll 28.

Loading device 50 is mounted on stringer 14 and can be displaced parallel to the longitudinal axis of supporting rollers 17–19. Loading device 50 comprises a displacement motor 52 connected to loading roller 54, which can be displaced in the direction of winding bed 20. Loading roller 54 is connected to displacement motor 52 by piston rod 53.

Ejection apparatus 60 for finished roll 28 comprises beam 62 extending above central supporting roller 18 and along the axial length thereof. Beam 62 is pivotal around the axis of supporting roller 18 by means of displacement motor 63 mounted on stringer 15.

Insertion device 70 is connected to ejection apparatus 60, and comprises clamp 72 disposed under beam 62, and in which a new core tube 36 is held, core tube 36 having been positioned from the side nearest machine 10.

Removal device 80 is provided for an ejected roll 28 from winding bed 20, and comprises lowering table 83 having a concave surface 82. The pivoting movement of lowering table 83 is effected by means of displacement motor 84.

The operation of winding machine 10 will now be described with reference to roll 28. Web strip 25 is slit from paper web 22 in lengthwise cutting device 24 and runs from below into winding bed 20, in which it is wound onto core tube 32. Tube 32 is gripped at the ends thereof by clamping heads 48 of holding assemblies 40, 41, displaced on either end of roll 28 and lying one behind the other in the plane of FIG. 1. Loading roller 54 of loading device 50 engages the circumference of roll 28 on the side away from winding bed 20. Roller 54 loads roll 28 with adjustable pressure. This pressure is considerable at the beginning of the winding process in order to obtain a firm initial winding, and is then reduced when winding roll 28 becomes larger. Holding assemblies 40 and 41 reduce the contact pressure or weight of winding roll 28 on supporting rollers 17 and 18 as the roll weight increases. This is achieved by operation of displacement motors 46 on sliding carriage 47 on holding arm 44. In addition, supporting rollers 17 and 18 are driven with different levels of torque to influence the roll density of roll 28.

When roll 28 has been fully wound, winding machine 10 is stopped. Roller 54 of loading device 50 is raised away from roll 28, and at the same time clamping heads 48 of holding assemblies 40 and 41 are withdrawn from core tube 32. Beam 62 of ejection apparatus 60 now forces the wound roll 28 over the apex of outer supporting roller 17 so that roll 28 is picked up in the concave surface 82 of lowering table 83 and placed on the ground or a loading structure adjacent machine 10. From there, finished roll 28 is conveyed from winding machine 10.

During this roll-changing process, at least that circumferential region of supporting roller 18 which has web strip 25 looped therearound is loaded with, or has applied thereto, a low pressure in order to hold web strip 25 securely thereto. As soon as wound roll 28 has been removed from winding bed 20, a severing device (not shown), which can be moved into bed 20 from therebelow, severs web strip 25 resting on roller 18 above bed 20 from roller 28. When roll 28 has been removed from winding bed 20, clamp 72 of insertion device 70 releases new core tube 36, which rolls on supporting roller 18 into winding bed 20. An adhesive applying device (not shown) can provided core tube 36, or the start of a new web strip 25, with an adhesive substance to make strip 25 stick to core tube 36. In winding bed 20, lowered clamping head 48 of holding assembies 40 and 41, respectively grip new core tube 36.

With regard to the changing of roll 30 in winding bed 21, web strip 26 is sucked against roller 19. The severing of web strip 26 is effected from the side nearest removal device 81 when finished roll 30 is positioned in lowering table 85, which pivots away from supporting roller 19. The severing device (not shown) is disposed under concave surface 86 of table 85 and is brought into action on web strip 26 stretched between supporting roller 19 and finished roll 30. A blowing pipe (not shown) connected to the severing device is used to wrap the start of a new web strip 26 around core tube 38, which has been positioned in winding bed 21 by insertion device 71. The start of strip 26, or the surface of new core tube 38, may be provided with an adhesive substance as earlier described.

After the start of a new web strip 25 or 26, which has been severed from a finished roll 28 or 30, respectively, has been attached to a respective new core tube 36, 38, the suction effect of supporting rollers 18 and 19 can be terminated and winding machine 10 can then be started for a new winding cycle. Since web strips 25 and 26 are fed into different winding beds 20 and 21, which are offset from each other, the winding of rolls 28 and 30 is effected entirely independently of each other. This is even more clearly shown in the third embodiment of the present invention illustrated in FIG. 4, wherein four web strips are wound into four rolls 228, 229, 230, and 231. Here again, the above described operation of machine 10, in appropriate sequence, takes place simultaneously for rolls 228–230.

Figure 2:
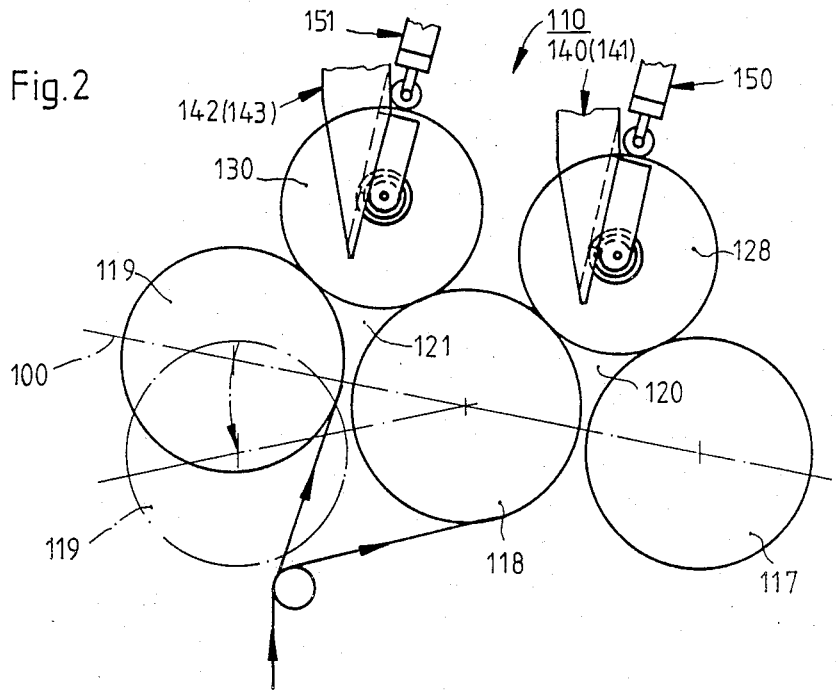
FIG. 2 is a diagram of a second embodiment of the present invention illustrating the three supporting rollers having the same diameters and with their axes lying in a common and obliquely inclined plane.
Figure 3:
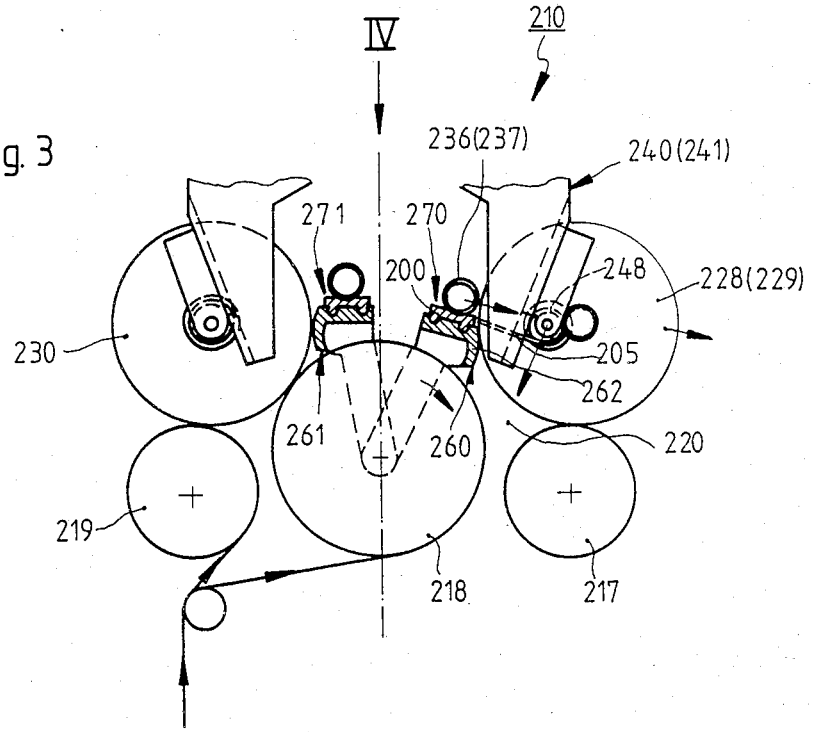
FIG. 3 is a broken-away sectional view of a third embodiment of the present invention taken along line III—III in FIG. 4 and viewed in the direction of the arrows, wherein the ejection apparatuses support on their upper sides the core tube insertion devices having slidable carriages supporting the core tubes.
Figure 4:
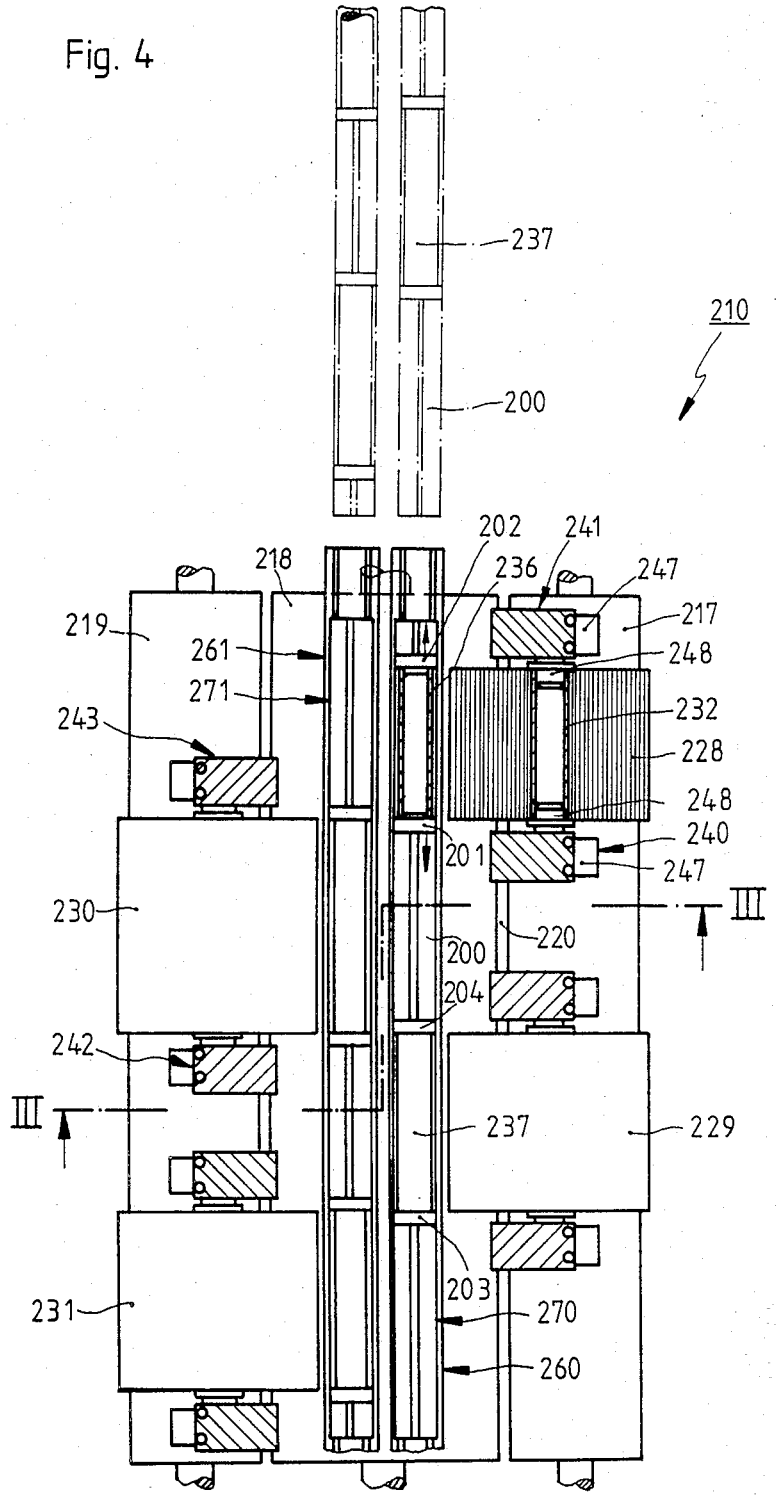
FIG. 4 is a top plan view of the embodiment in FIG. 3 and viewed in the direction of the arrow IV.

Referring to FIGS. 2–4, second and third embodiments of winding machine 10 will be described, and which correspond in large measure to that of the first embodiment illustrated in FIG. 1. For this reason, assemblies, apparatuses, and devices which function in the same way have been designated with the same last two numerals.

Referring to FIG. 2, winding machine 110 illustrates a second embodiment of the present invention. Supporting rollers 117, 118, and 119 are equally spaced-apart and have the same diameters. Their longitudinal axes lie in a common plane 100 which, viewed in the axial direction, is inclined. In this manner, identical loading conditions are obtained for the separate rolls 128 and 130 in respective winding beds 120, 121. Further, the design and arrangement of winding machine 110 is such that holding assemblies 140, 141 and loading device 150 cooperate with winding bed 120, and holding assemblies 142, 143 and loading device 151 cooperate with winding bed 121. To facilitate the ejection of wound roll 130 from winding bed 121, supporting roller 119, which is disposed higher, is mounted such that it can be lowered relative to rollers 117, 118 as indicated in broken lines.

Referring to FIGS. 3 and 4, winding machine 210 illustrates a third embodiment of the present invention, and differs from winding machine 10, illustrated in FIG. 1, mainly in that it has additional wound roll ejection devices 260, 261 and core tube insertion devices 270, 271. FIG. 3 illustrates in its left hand portion ejection device 261 and core tube insertion device 271 in their rest position, while the right portion of FIG. 3 illlustrates ejection device 260 and core tube insertion device 270 in their working position. The description below refers to the right hand or working position illustrated in FIG. 3.

The ejection apparatus 260 comprises ejection beam 262 arranged over central supporting roller 218 and pivotal thereabout. Ejection beam 262 has core tube insertion device 270 mounted on its upper side. Insertion device 270 includes a sliding carriage 200 that can be displaced in a longitudinal direction when beam 262 is in its rest position, and is then loaded with new core tubes 236, 237 while carriage 200 is moved out of winding machine 210, as illustrated in broken lines in FIG. 4. The loading of sliding carriage 200 can be effected from a core tube magazine (not shown). To insure that core tubes 236, 237 maintain correct positions on sliding carriage 200, carriage 200 is provided with clamping shoes 201, 202, 203, and 204. Core tubes 236 and 237 on sliding carriage 200 which has been moved out of machine 210, are held by clamping shoes 201, 202 and 203, 204, respectively. Core tubes 236 and 237 are then maintained in place when sliding carriage 200 is moved into machine 210, until they are subsequently delivered to winding bed 220.

When the winding process has been completed, ejection apparatus 260 is operated to push finished roll 228 over the apex of outer roller 217 and out of winding machine 210 (see the right hand half of FIG. 3). Only when winding bed 220 is free does insertion device 270 release new core tube 236 with ejection beam 262 in the working position. Core tube 236 is released when clamping shoes 201 and 202 are opened simultaneously and when guide rails 205 for core tube 236 are extended from holding assemblies 240 and 241, which are disposed on either side of finished roll 228. Core tube 236 rolls obliquely downwardly on rails 205 to clamping heads 248, which grip tube 236. Thereafter, guide rails 205 are retracted into holding assemblies 240, 241, and ejection apparatus and insertion device 270 return to their rest position. Sliding carriages 247 of holding assembies 240, 241 position new core tube 236 in winding bed 220 to begin a new winding cycle.

While this invention has been described as having preferred embodiments, it will be understood that it is capable of further modifications. This application is therefore intended to cover any variations, uses or adaptations of the invention following the general principles thereof, and including such departures from the present disclosure as come within known or customary practice in the art to which this invention pertains and fall with the limits of the appended claims.

What is claimed is:

1. A winding machine adapted simultaneously to wind strips of web onto at least two winding rolls formed on at least two core tubes, respectively, the strips being slit lengthwise from a web and offset relative to each other, said winding machine including a frame having three generally horizontally disposed supporting rollers therein, the longitudinal axes of said supporting rollers being generally parallel to each other, each two adjacent ones of said supporting rollers forming a winding bed therebetween; at least two holding assemblies adapted to engage the ends of the respective core tubes; and at least two removal means adapted to remove the respective rolls, characterized in that:

said three supporting rollers are adjacently disposed such that each said winding bed extends above the common center axis plane of its said adjacent rollers, wherein the web strips are supplied from below and into respective said winding beds and against one of said supporting rollers forming their respective said winding beds, at least two ejection means are disposed above the center one of said supporting rollers and adapted to move generally simultaneously the rolls from their respective said winding beds and over the adjoining one of the two outermost ones of said supporting rollers, said at least two removal means are disposed adjacent to respective outermost ones of said supporting rollers, at least two inserting means are disposed above said three supporting rollers and adapted to insert new core tubes into respective said winding beds, severing means adapted to sever the web strip when rolled, and at least two attaching means adapted to attach new web strips to the new core tubes.

2. The machine of claim 1 wherein said three supporting rollers are horizontally disposed with their respective axes in a common plane.

3. The machine of claim 2 wherein said three supporting rollers are arranged relative to each other such that the common plane containing their respective axes is inclined from the horizontal.

4. The machine of claim 3 wherein the more elevated one of the two outermost said supporting rollers is generally downwardly movable relative to the other said supporting rollers.

5. The machine of claim 1 wherein the axis of the center one of said three supporting rollers is above the common center axis plane containing the axes of the two outermost ones of said supporting rollers.

6. The machine of claim 1 wherein said three supporting rollers are approximately of the same diameter.

7. The machine of claim 1 wherein the diameter of the center one of said supporting rollers is greater than the diameters of the two outermost ones of said supporting rollers.

8. The machine of claim 1 wherein each said holding assembly includes clamping heads adapted to engage the ends of a core tube, said clamping heads being movable along the path of a roll axis with adjustable weight-relieving of the roll.

9. The machine of claim 1 further comprising at least two loading assemblies, each said loading assembly including an adjustable loading roller operative toward a respective said winding bed.

10. The machine of claim 1 wherein each said ejection means includes a beam member extending axially along its respective said winding bed, said beam member being pivotal about the center one of said supporting rollers and having mounted thereon a respective said inserting means.

11. The machine of claim 10 wherein each said inserting means includes a carriage slidably disposed longitudinally on said beam member and slidable between a first position wherein said carriage is disposed generally within said frame and a second position wherein said carriage is disposed generally outside said frame, said carriage being adapted to be loaded with core tubes when in said second position.

12. The machine of claim 11 wherein each said inserting means further includes a plurality of clamping members adapted to clamp core tubes disposed on said carriage.

13. The machine of claim 12 wherein each said holding assembly includes a plurality of guides extendable towards a respective said inserting means, said guides being adapted to receive and guide a core tube from said inserting means to said holding assembly, said clamping heads being adapted to engage the ends of the core tube.

14. The machine of claim 13 wherein said plurality of guides are a respective plurality of rail members upwardly extendable from a respective said holding assembly toward a respective said inserting means, said rail members being adapted to receive and guide core tubes obliquely downwardly to respective said clamping heads.

15. The machine of claim 1 wherein said severing means includes a severing blade disposed below said supporting rollers, said severing blade being adapted to sever one of the web strips at a point between its respective said outermost supporting roller and its respective said removal means.

* * * * *